US010132109B2

(12) United States Patent
Bendel et al.

(10) Patent No.: US 10,132,109 B2
(45) Date of Patent: Nov. 20, 2018

(54) LOCK HAVING RESTRICTED GUIDANCE FOR A PAWL

(75) Inventors: Thorsten Bendel, Oberhausen (DE); Serkan Gülkan, Hattingen (DE); Karsten Barth, Hattingen (DE); Ulrich Weichsel, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 13/322,451

(22) PCT Filed: May 19, 2010

(86) PCT No.: PCT/DE2010/000567

§ 371 (c)(1),
(2), (4) Date: Nov. 23, 2011

(87) PCT Pub. No.: WO2010/142261

PCT Pub. Date: Dec. 16, 2010

(65) Prior Publication Data

US 2012/0068480 A1 Mar. 22, 2012

(30) Foreign Application Priority Data

Jun. 12, 2009 (DE) ..... 10 2009 026 920
Mar. 30, 2010 (DE) ..... 10 2010 003 483

(51) Int. Cl.

| | |
|---|---|
| ***E05C 3/16*** | (2006.01) |
| ***E05B 85/26*** | (2014.01) |
| *E05C 3/04* | (2006.01) |
| *E05C 3/06* | (2006.01) |
| *E05B 15/16* | (2006.01) |

(52) U.S. Cl.
CPC ..... *E05B 85/26* (2013.01); *E05B 15/1635* (2013.01); *Y10T 292/1052* (2015.04); *Y10T 292/1075* (2015.04)

(58) Field of Classification Search
CPC ..... E05B 81/06; E05B 81/14; E05B 85/26; Y10T 29/49826; Y10S 292/23
USPC ..... 292/DIG. 23, 216, 220, 210, 201, 200, 292/198, 217
See application file for complete search history.

(56) References Cited

U.S. PATENT DOCUMENTS 2,707,124 A * 4/1955 Wartian ..... E05B 77/265 292/280
3,504,511 A * 4/1970 Allen ..... 70/241
4,203,621 A * 5/1980 Noel ..... E05B 85/26 292/216

(Continued)

FOREIGN PATENT DOCUMENTS

DE 42 28 235 A1 3/1994
DE 199 02 561 A1 8/2000

(Continued)

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The invention relates to a lock for a motor vehicle with a locking mechanism comprising a catch (4), a first-position pawl (13), a primary-position pawl (6), a blocking lever for blocking the primary-position pawl, and a driver for the first-position pawl, wherein the driver is a lateral contour area of the first-position pawl (13) and functions to rotate the primary-position pawl out of its notched position.

10 Claims, 4 Drawing Sheets

(56) References Cited

U.S. PATENT DOCUMENTS 4,667,991 A * 5/1987 Pebre ..... E05B 81/20 292/201
5,118,146 A * 6/1992 Watanuki ..... E05B 83/16 292/216
5,273,325 A * 12/1993 Zimmermann ..... E05B 81/22 292/216
5,516,164 A * 5/1996 Kobayashi ..... E05B 81/20 292/201
5,634,677 A * 6/1997 Buscher ..... E05B 81/06 292/216
5,738,393 A * 4/1998 Chao ..... E05B 83/24 292/216
5,802,894 A * 9/1998 Jahrsetz ..... E05B 77/48 292/144
5,938,252 A * 8/1999 Uemura ..... E05B 81/14 292/201
5,961,163 A * 10/1999 Brackmann ..... E05B 81/06 292/201
5,979,951 A * 11/1999 Shimura ..... E05B 85/26 292/216
6,056,334 A * 5/2000 Petzold ..... E05B 81/14 292/201
6,076,868 A * 6/2000 Roger, Jr. ..... E05B 81/14 292/199
6,148,651 A * 11/2000 Roncin ..... E05B 77/265 292/201
6,168,216 B1 * 1/2001 Nakajima ..... E05B 81/20 292/201
6,382,687 B1 * 5/2002 Gruhn ..... E05B 81/14 292/201
6,428,058 B1 * 8/2002 Graute ..... E05B 85/01 292/201
6,497,436 B1 * 12/2002 Deblock ..... E05B 81/06 292/201
6,520,550 B2 * 2/2003 Kunst ..... E05B 77/24 292/216
6,540,271 B1 * 4/2003 Kalsi ..... E05B 81/14 292/216
6,540,272 B2 * 4/2003 Spurr ..... E05B 85/243 292/216
6,575,507 B2 * 6/2003 Reddmann ..... E05B 81/14 292/201
6,705,649 B1 * 3/2004 Reddmann ..... E05B 81/06 292/201
6,773,042 B2 * 8/2004 Spurr ..... E05B 77/02 292/201
6,789,825 B2 * 9/2004 Kalargeros ..... E05B 85/26 292/201
6,817,636 B1 * 11/2004 Evans ..... E05B 81/14 292/201
6,848,727 B1 * 2/2005 Cetnar ..... E05B 81/20 292/201
6,866,311 B2 * 3/2005 Spurr ..... E06B 83/16 292/201
6,988,749 B2 * 1/2006 Hashiba ..... E05B 81/14 292/201
7,032,937 B2 * 4/2006 Boecker ..... E05B 81/14 292/201
7,080,861 B2 * 7/2006 Watanabe ..... E05B 83/36 292/216
7,111,878 B2 * 9/2006 Kachouh ..... E05B 81/14 292/201
7,175,212 B2 * 2/2007 Cetnar ..... E05B 81/20 292/201
7,234,736 B2 * 6/2007 Kachouh ..... E05B 81/14 292/201
7,275,771 B2 * 10/2007 Crotti ..... E05B 77/34 292/201
7,293,806 B2 * 11/2007 Umino ..... E05B 77/54 292/201
7,309,100 B2 * 12/2007 Sawajiri ..... E05B 83/38 292/336.3
7,311,341 B2 * 12/2007 Coleman ..... E05B 77/26 292/216
7,413,225 B2 * 8/2008 Spurr ..... E05B 17/007 292/201
7,434,852 B2 * 10/2008 Spurr ..... E05B 85/26 292/201
7,475,920 B2 * 1/2009 Bigazzi ..... E05B 81/14 292/201
7,475,922 B2 * 1/2009 Ottino ..... E05B 85/26 292/216
7,475,992 B2 * 1/2009 Abu-Ageel ..... G02B 6/0096 353/31
7,500,700 B2 * 3/2009 Kunst ..... E05B 81/14 292/201
7,503,598 B2 * 3/2009 Graute ..... E05B 77/38 292/201
7,568,740 B2 * 8/2009 Brose ..... E05B 81/06 292/201
7,568,741 B2 * 8/2009 Odahara ..... E05B 81/06 292/201
7,581,767 B2 * 9/2009 Fujihara ..... E05B 81/20 292/201
7,946,634 B2 * 5/2011 Bendel ..... E05B 81/14 292/201
7,963,576 B2 * 6/2011 Bigazzi ..... E05B 81/14 292/201
7,963,796 B2 * 6/2011 Sypolt ..... H01R 12/58 439/511
8,025,319 B2 * 9/2011 Graute ..... E05B 85/26 292/201
8,235,428 B2 * 8/2012 Hunt ..... E05B 85/26 292/216
8,474,888 B2 * 7/2013 Tomaszewski ..... E05B 77/26 292/201
8,480,138 B2 * 7/2013 Bendel ..... E05B 85/26 292/201
8,590,946 B2 * 11/2013 Cumbo ..... E05B 81/14 292/201
8,827,329 B2 * 9/2014 Scholz ..... E05B 85/26 292/200
8,955,889 B2 * 2/2015 Bendel ..... E05B 81/20 292/200
9,057,211 B2 * 6/2015 Scholz ..... E05B 85/26
9,151,092 B2 * 10/2015 Scholz ..... E05B 85/26
9,187,936 B2 * 11/2015 Kim ..... E05B 83/24
9,212,509 B2 * 12/2015 Pettengill ..... E05B 85/00
9,243,429 B2 * 1/2016 Bendel ..... E05B 77/06
9,534,425 B2 * 1/2017 Hunt ..... E05B 77/06
2005/0167990 A1 * 8/2005 Orzech ..... E05B 81/14 292/201
2007/0271973 A1 * 11/2007 Ottino ..... E05B 85/26 70/237
2008/0203737 A1 * 8/2008 Tomaszewski ..... E05B 77/26 292/216
2008/0224482 A1 * 9/2008 Cumbo ..... E05B 77/02 292/216
2010/0052336 A1 * 3/2010 Bendel ..... E05B 85/26 292/196
2011/0012376 A1 * 1/2011 Hunt ..... E05B 85/26 292/216
2011/0025077 A1 * 2/2011 Meyer ..... E05B 83/16 292/216
2011/0127780 A1 * 6/2011 Barth et al. ..... 292/213
2014/0203575 A1 * 7/2014 Brickner ..... E05B 77/12 292/341.17
2014/0284939 A1 * 9/2014 Wittelsbuerger ..... E05B 77/06 292/92
2014/0284941 A1 * 9/2014 Wittelsbuerger ..... E05B 77/06 292/92
2014/0291998 A1 * 10/2014 Pettengill ..... E05B 85/00 292/96

(56) References Cited

U.S. PATENT DOCUMENTS

FOREIGN PATENT DOCUMENTS

| | | | | |
|---|---|---|---|---|
| DE | 19902561 A1 * | 8/2000 | ..... | E05B 77/06 |
| DE | 201 04 625 U1 | 9/2002 | | |
| DE | 10 2007 003 948 A1 | 5/2008 | | |

* cited by examiner

LOCK HAVING RESTRICTED GUIDANCE FOR A PAWL

CROSS-REFERENCE TO RELATED APPLICATIONS

This is a National Stage Application of International Patent Application No. PCT/DE2010/000567, with an international filing date of May 19, 2010, which is based on German Patent Application No. 10 2009 026 920.7, filed Jun. 12, 2009 and German Patent Application No. 10 2010 003 483.5 filed Mar. 30, 2010.

BACKGROUND OF THE INVENTION

1. Field of the Invention

The invention relates to a lock for a motor vehicle with a locking mechanism comprising a catch and two pawls, by means of which the catch can be snapped into two respective closed positions. One of the pawls engages the catch in a primary position (hereinafter called the "primary-position pawl"). The other pawl engages the catch in a first position (hereinafter called the "first-position pawl"). The lock also includes a blocking lever for said primary-position pawl. Such a lock is known from DE 10 2007 003 948 A1.

2. Brief Description of the Related Art

A catch of a motor vehicle lock has a fork-shaped inlet slot into which a locking pin of a vehicle door or hatch enters when the car door or hatch is closed. The locking pin then rotates the catch from an open position to a closed position. When the catch reaches the closed position, the locking pin can no longer leave the inlet slot of the catch. In a closed position, the pawl engages the catch such that the catch can no longer be rotated back into the open position.

Known are locks with two closed positions, which are assumed consecutively during the closing of the catch, namely the so-called first position and the so-called primary position.

To prevent the pawl from being unexpectedly moved out of these notched positions, a blocking lever can be provided that blocks such movement when the catch assumes a notched position. Such a blocking lever is necessary for the primary-position pawl of the lock described in DE 10 2007 003 948 A1 because the catch and the primary-position pawl are constructed such that the pawl assuming the primary position pushes the primary-position pawl out of the notched position.

The rotatably arranged blocking lever described in DE 10 2007 003 948 A1 is biased by a spring. Because of this bias, when the catch is not in the primary position, the blocking lever exerts pressure on the primary-position pawl toward the direction of the catch. This pressure is responsible for ensuring that the primary-position pawl is moved into a notched position when the catch reaches the primary position. The bias then further ensures that the blocking lever is ultimately moved into a blocked position to complete the vehicle door or hatch closing.

To unlock the lock, the blocking lever is rotated with the help of the first-position pawl against the biasing force until the blocking lever sets free the primary-position pawl. The primary-position pawl is then pushed by the catch from the notched position or is stricken by a driver of the first-position pawl and so is moved out of the notched position. The driver is a long hole in the first-position pawl into which a pin attached to the primary-position pawl extends. Subsequently, the catch rotates from the primary position into its open position due to an appropriately set bias. The locking pin can then move out of the inlet slot, and the attached vehicle door or hatch can be pushed ajar.

It is one object of the invention to provide an inexpensive lock for a motor vehicle that can fit into a small space.

BRIEF DESCRIPTION OF THE INVENTION

The object of the invention is achieved by providing a lock having the characteristics of the first claim. Advantageous embodiments are described in the dependent claims.

To achieve the object of the invention, a lateral contour area of the first-position pawl is provided to function as a driver that strikes and moves a pin attached to the primary-position pawl. Because of this, the primary-position pawl can be rotated out of its notched position. Because a slot does not need to serve as a driver, material is saved and installation space is reduced.

In one embodiment, the primary-position pawl is pushed out of a notched position by the catch, as described in DE 10 2007 003 948 A1, and the pin attached to the primary-position pawl is made of plastic. Usually, it would be necessary to make the pin out of metal for reasons of stability because of the stresses experienced by the pin. The stresses are, however, relatively small in this embodiment because the primary-position pawl is pushed out of a notched position by the catch. In general, this pressure is high enough to move the primary-position pawl out of a notched position after the primary-position pawl is released by the blocking lever. Even if the driver should still strike the pin, only a small force would be required to rotate the primary-position pawl out of the notched position. It is, therefore, not necessary to manufacture the pin from metal. A relatively light and cheap pin made of plastic, e.g., polypropylene, is, therefore, sufficient.

In one embodiment of the invention, the primary-position pawl comprises a lever arm to which the pin is attached. This lever arm is made particularly of metal and is encased with plastic or is made at least partially of plastic. The remaining portion of the primary-position pawl is made of metal. In this case, a limiter is provided for the lever arm, and this limiter is fully or partially made of plastic. The limiter limits the rotation of the primary-position pawl in the direction toward a notched position. The limiter ensures that the primary-position pawl does not rotate past a certain position due to the inertial mass, for example, during rapid rotation.

The limiter advantageously also functions as a stop for the first pawl, which is preferably biased by a spring toward a notched position. If a bias is present, the first-position pawl is prevented by the stop from rotating past its notched position. The primary-position pawl, however, is not biased. The corresponding lever arm of the primary-position pawl does not, therefore, normally put pressure on the limiter, especially since the primary-position pawl, and hence also the limiter, is pushed away by the catch in the opposite direction.

The limiter is preferably made of a metal pin, which is encased by a sheath of elastic material. In this way, the impact of the corresponding lever arm of the first-position pawl is dampened. In addition, the plastic of the primary-position pawl is treated with care.

To bias the first-position pawl, the first-position pawl preferably further comprises an additional lever arm, which extends into an area, which runs perpendicularly to the housing wall, to which wall the catch is rotatably attached.

In this way, an area is provided against which an arm of the torsion spring can press. In addition, this perpendicular area is also used in order to strike the first-position pawl, and preferably to move it by means of a motor when the associated vehicle door or hatch is opened. The height of the lock does not need to be increased, therefore, when the two pawls are arranged one on top of the other, as is known from DE 10 2007 003 948 A1. The perpendicular arrangement thus ensures that the base of the lock does not need to be increased.

DETAILED DESCRIPTION OF THE INVENTION

An exemplary embodiment of the invention shown in the figures will be explained hereinbelow in more detail. Advantages of further embodiments of the invention will be illustrated with reference to the exemplary embodiment.

Figure 1:
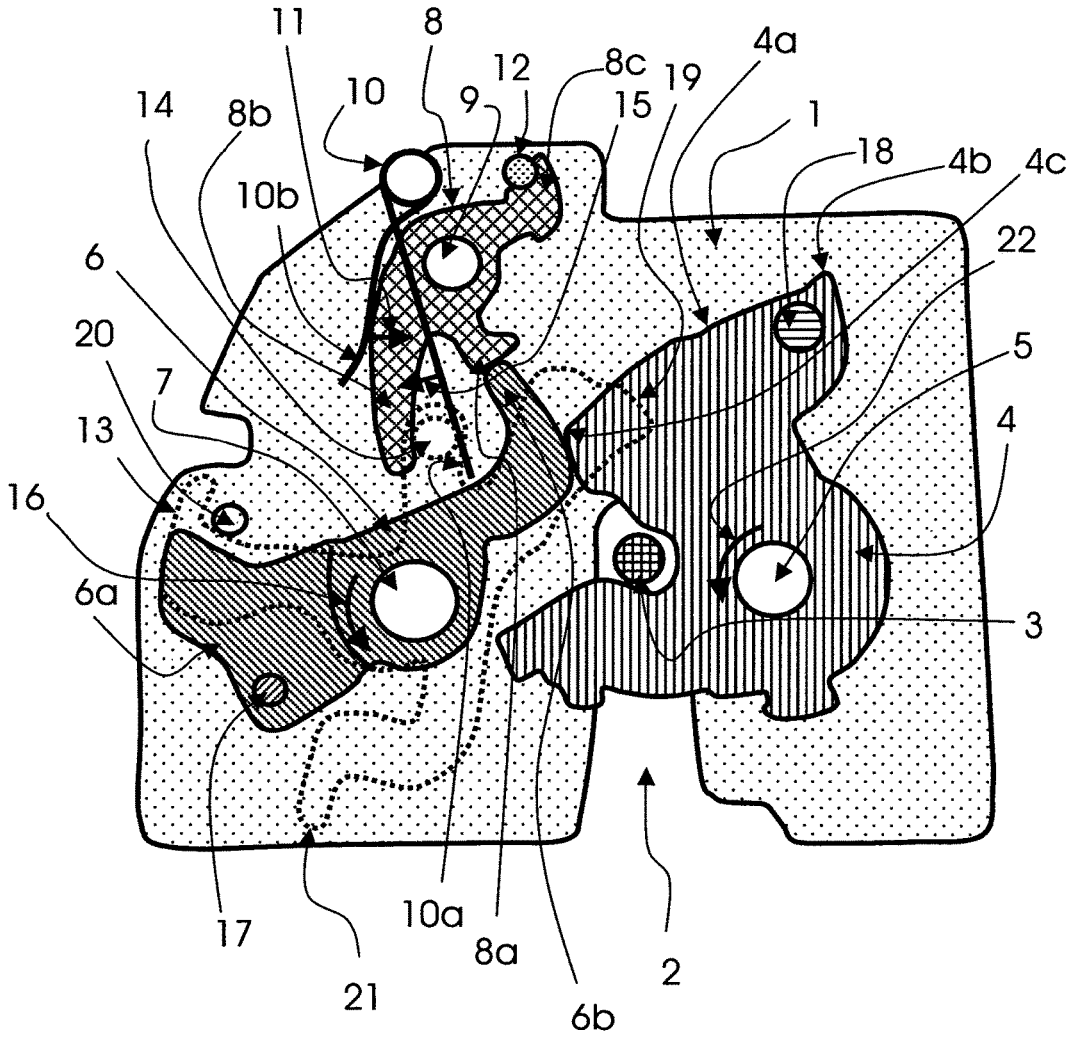
FIG. 1 shows a closed position of a lock with a first-position pawl being transparent (not shown)

FIG. 1 shows a plan view of a housing wall 1 of a vehicle lock. The housing wall 1 is provided with an inlet slot 2, into which a locking pin 3 of a vehicle door or vehicle hatch enters when the corresponding vehicle door or vehicle hatch is closed. The catch 4 is rotatably mounted on the housing wall 1 and can be rotated about its mounting axis 5. FIG. 1 shows the primary position, in which the locking pin 3 located in the inlet slot 2 in the wall housing is enclosed by the inlet slot of the catch such that the locking pin 3 can no longer be moved out of the inlet slot 2 in the wall housing. The corresponding door or hatch of the vehicle is thus closed. It is obvious that the primary position is shown here because in this figure, the action of turning back the catch according to the arrow direction 22 toward the open position is blocked by the primary-position pawl 6. The primary-position pawl 6 is also mounted on the housing wall 1 and is rotatable about its mounting axis 7. The catch is biased toward the direction of the open position, preferably by a spring (not shown). Because of this bias, the catch presses diagonally against a stop of the primary-position pawl. This diagonal movement pushes the main locking pawl out of the notched position.

If the catch is not biased by a spring, when said vehicle door or hatch is opened, at least the locking pin 3 causes the rotation of the catch 4 toward the open position, as indicated by the arrow 22. The associated torque then pushes the primary-position pawl 6 out of the notched position.

However, this is prevented in the primary position by the blocking lever 8 when the vehicle door or hatch is closed, as shown. The blocking lever 8 is also mounted on the housing wall 1 and can be rotated about its mounting axis 9. On a lateral contour area of the blocking lever 8 is disposed an arm 10*b* of a spring 10. The spring 10 is biased such that the arm 10*b* of the spring 10 presses the blocking lever in the direction toward the shown blocking position (in the direction of arrow 11). The rotational movement of the blocking lever caused thereby is limited, as shown by the stop 12, which is attached to the housing wall 1 in the form of a protruding pin. The stop 12 causes the blocking lever to be positioned always very precisely in the same blocking position, which is particularly important for the proper functioning. The spring 10 is arranged predominantly laterally next to the blocking lever 8 as well as next to the first-position pawl to allow for a low profile. Only one arm 10*a* of the spring 10 extends beyond the blocking lever 8.

Above the primary-position pawl 6 is arranged a first-position pawl. The first-position pawl is also pivotally mounted on the shaft 7 and can, therefore, also be rotated around the axis 7. The outline 13 of the first-position pawl is indicated with dots. The first-position pawl 13 comprises a pin 14, which extends down from the first-position pawl in the direction toward the housing wall 1. At this pin 14, which is attached to the first-position pawl, is disposed the other arm 10*a* of the spring 10. The other arm of the spring 10 pushes toward the direction of the pin 14 along the arrow 15. In the primary position, the pin 14 abuts a lateral contour area of the blocking lever 8. When the first-position pawl 13 is turned in the direction of the arrow 16, the pin 14 causes the blocking lever 8 to be rotated out of the blocking position. The spring arm 10*a* can follow the movement of the stop or the pin 14 such that the rotation of the first-position pawl 13 is not limited by an opposing force, which would otherwise originate from the spring arm 10*b*. This facilitates the rotation of the blocking lever 8 by the first-position pawl 13 out of the blocking position. When the blocking lever 8 is moved from the blocking position, the primary-position pawl 6 is pushed away by the catch from its shown notched position. Additionally or alternatively, the lateral contour area of the first-position pawl 13 strikes a protruding pin 17 serving as a stop, which is attached to the primary-position pawl 6. This pin is made of plastic and is formed as a single piece with the plastic portion 6*a*. This has the consequence that the primary-position pawl 6 is rotated out of the shown notched position and releases the catch. The catch then pivots in the direction of the arrow 22 toward the open position and ultimately sets free the locking pin 3. The corresponding door or gate can then be opened.

The catch exerts a sufficiently great pressure on the primary-position pawl primarily at the time when a door seal pressure transfers high opening forces onto the catch. However, when the door seal pressure is relatively low, a problem may arise in that the catch does not transfer a sufficiently large torque onto the primary-position pawl and the primary-position pawl cannot be pushed out of the notched position. The aforementioned lateral contour area of the first-position pawl ensures that the primary-position pawl is reliably rotated out from its notched position, even when a too low of a door seal pressure is applied. This embodiment of the invention described herein is technically simpler than the solution described in DE 10 2007 003 948 A1.

The first-position pawl 13 can also lock the catch 4 when a protruding pin 18 of the catch 2 strikes against the lateral contour area 19 of the first-position pawl 13 and thus prevents the rotation of the pawl toward the open position in accordance with the arrow 22. The first-position pawl 13 is preferably biased by a spring (not shown) in the direction toward its locked position. One arm of this spring then pushes against an end 21, which is perpendicular to the wall 1. A protruding pin 20, which serves as a stop and is secured to the housing wall 1, prevents further rotation of the first-position pawl beyond its notched position. This pin 20 is, for reasons of stability, preferably made of metal.

The primary-position pawl 6 is also made of metal and is preferably not directly spring loaded. The primary-position pawl 6 is instead appropriately rotated alone by other components, particularly by the rotation of the catch 4, the first-position pawl 13, and/or the blocking lever 8, e.g., by the rotation of the blocking lever 8 into a notched position (primary position). The corresponding rotation of the blocking lever is caused by the supplied bias of the spring 10.

In order to move the primary-position pawl, with the help of the blocking lever, suitably into a notched position, the hook-like endings 6*b* and 8*a* have been found to be particularly suitable. The head of the hook 6*b* of the primary-position pawl acts as a stop for the catch. The tip of the hook 6*b* is blocked in the primary position by the head of the hook 8*a*. If the blocking lever 8 is rotated out of the blocked position, then the two hooks 6*b* and 8*a* interlock. The top end 6*b* finally pushes the hook 8*a* so far outward that the lever arm 8*b* of the pin 14 is lifted, whereby the tension of the spring 10 is increased (see also FIG. 3). The rotation of the first-position pawl 13 is further facilitated because the first-position pawl 13 no longer transfers its moment of inertia onto the blocking lever 8. The movement of the tip 6*b* or the primary-position pawl 6, which is responsible for moving the arm 8*b* away from the pin 14, is then caused by the catch, which rotates toward the open position, wherein the lateral contour area 4*a* presses against the then-adjacent lateral contour area of the hook 6*b*. As shown, the end portion 4*b* of the contour area 4*a* is angled or bent outwards (as seen from the catch) in order to rotate the primary-position pawl and thereby to rotate the hook 6*b*, particularly far along the direction indicated by arrow 16. As a result, the lever arm 8*b* is moved particularly far away from the stop 14 and a desirable bias is then provided by the spring 10. Advantageously, the tip of the hook 6*b* is longer than the tip of the hook 8*a* in order to provide a particularly large bias of the spring 10. Because the hook 8*a* does not have to achieve such an effect, the hook 8*a* is relatively short. All of this ensures a particularly reliable operation.

If the catch is rotated from the open position toward the closed position up to the first position, the first-position pawl then snaps into its notched position, wherein the first-position pawl is then rotated opposite to the direction of the arrow 16 until a further rotation is limited by the stop 20, as shown in FIG. 1. In this first position, the corresponding lateral contour section of the hook 6*b* still lies against the lateral contour area 4*a*. This blocks the rotation of the blocking lever 8 such that the arm 8*b* is moved in the direction of the arrow 11. The bias of the spring 10 is then further increased in a desired manner. When the lateral contour portion 4*a*, extending from the corner point 4*b* to the corner point 4*c*, ultimately sets free the primary-position pawl 6, a high biasing force is provided in order to reliably move the primary-position pawl into a notched position when the corresponding vehicle door or hatch is closed.

In order to rotate the first-position pawl out of its notched position, so as to unlock the lock, the first-position pawl is stricken within the grip area 21 and rotated. The striking and rotating of the first-position pawl 13 can be done manually or with the help of a motor. Since the first-position pawl can also be rotated backwards by a motor, a spring that biases the first-position pawl toward a notched position is not mandatory. For performance and safety reasons, the provision of such a spring is, however, beneficial.

Figure 2:
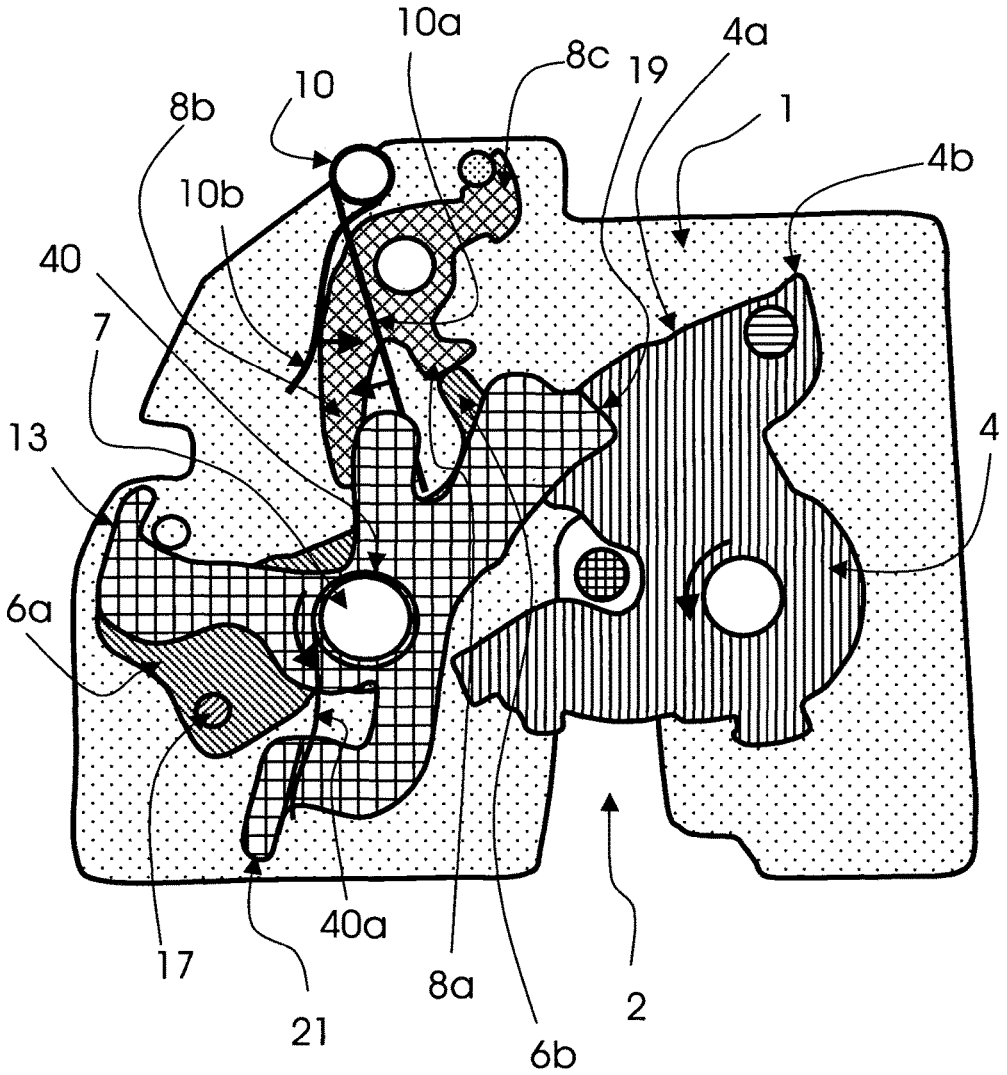
FIG. 2 shows the closed position of the lock of FIG. 1.

FIG. 2 shows the lock of FIG. 1. However, the first-position pawl 13 is now shown (is not transparent). Therefore, the first-position pawl 13 partially covers inter alia the primary-position pawl 6. FIG. 2 illustrates that the area 21 is perpendicular upwards with respect to the wall 1 in order to strike the first-position pawl without enlarging the size of the lock and in order to rotate it out of a notched position by means of a motor. Furthermore, the first-position pawl is biased toward a notched position by a pre-tensioned spring arm 40*a* of a torsional spring 40, which arm rests against the perpendicular end area 21.

Figure 3:
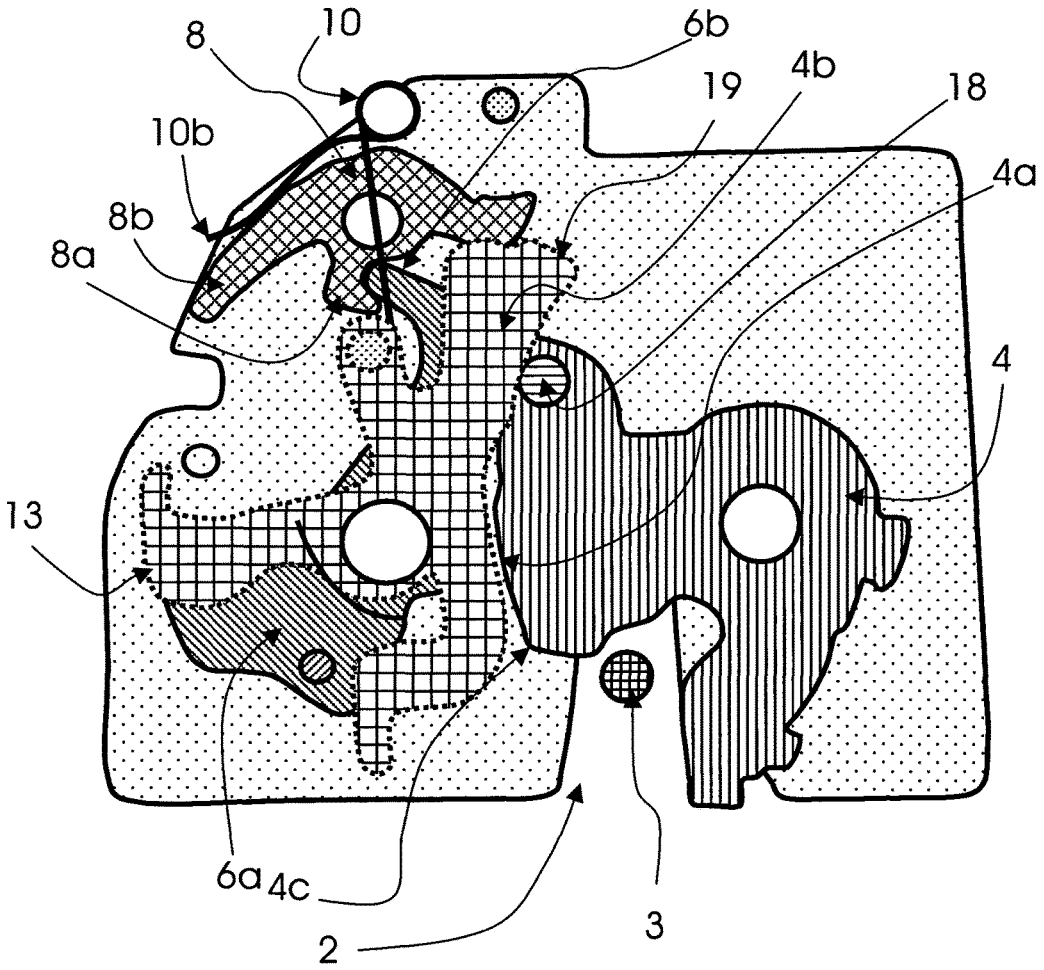
FIG. 3 shows an open position of the lock of FIG. 1.

FIG. 3 shows the position of the catch 4, the primary-position pawl 6, the blocking lever 8, the spring 10, and the locking pin 3 in the open position of the lock. In addition, the position of the first-position pawl 13 is outlined transparently. The locking pin 3 can now be moved out of the inlet slot and the attached door or hatch can be opened. The tip of the hook 6*b* of the primary-position pawl pushes the hook-shaped lever arm 8*a* and thereby also the lever arm 8*b* of the blocking lever 8 far to the outside. The spring arm 10*b* is thus also pushed wide to the outside and the spring 10 provides a strong bias. The lateral tip 4*b* of the lateral contour 4*a*, which tip extends to the corner point 4*c*, ensures that the lever 8*b* is pushed by the hook 6*b* particularly far to the outside and so that the spring 10 becomes particularly strongly tensioned. FIG. 3 also illustrates that the first-position pawl 13 does not contribute to the increased tension of the spring 10.

When a vehicle door, through which vehicle occupants enter and exit, or a hatch with the locking pin 3, is slammed, the locking pin 3 turns the catch 4 toward the closed position. The back side of the hook 6*b* then slides along the lateral contour 4*a*. This leads to an initial slight decrease in the tension of the spring 10 because at that time, the blocking lever 8 also initially rotates slightly backwards in the direction toward a blocked position. However, the pin-shaped stop 14 slides also in the direction toward the lateral contour 19 of the first-position pawl 13 and ultimately sets free the first-position pawl 13 such that the first-position pawl 13 rotates into a notched position due to a bias, which again increases the tension of the spring 10.

Figure 4:
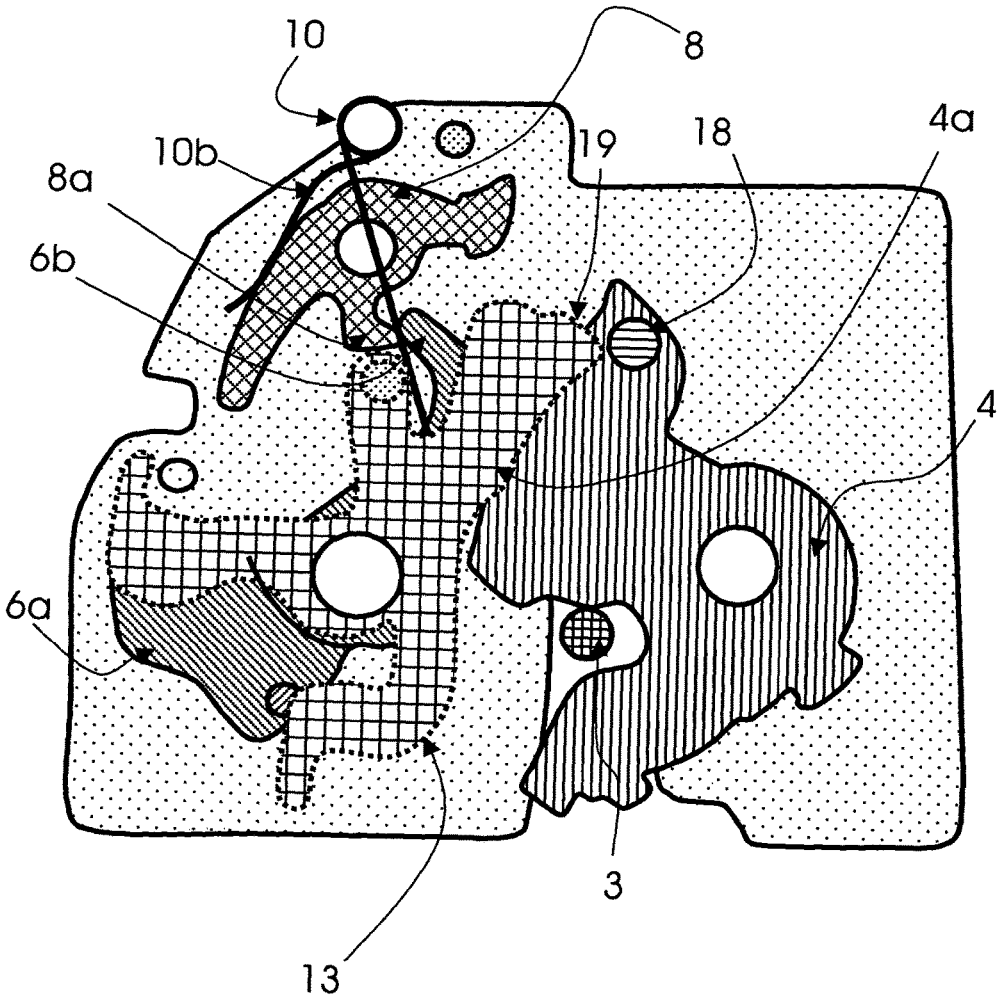
FIG. 4 shows an intermediate position of the lock of FIG. 1.

FIG. 4 shows an intermediate position between the open position and closed position of the catch 4. If the catch 4 is rotated somewhat further in the direction toward the closed position by the locking pin 3, the first-position pawl 13 snaps into a notched position and increases the tension on the spring 10. The back side of the hook 6*b* is pressed against the lateral contour area 4*a* of the catch 4 by the lever arm 8*a* of the blocking lever 8, which is biased by the spring 10.

The invention claimed is:

1. A lock for a motor vehicle with a locking mechanism comprising a catch, a first-position pawl, a primary-position pawl, and a blocking lever having a blocking position for blocking said primary-position pawl in a primary position, wherein the first-position pawl abuts against the blocking lever and moves to drive the blocking lever from the blocking position to permit the primary-position pawl to move out of the primary position, wherein the first-position pawl comprises a driver formed by a lateral contour area of said first-position pawl, the lateral contour area being an outer perimeter edge of the driver, and the driver moves from being spaced apart from into a direct engagement with an abutment on said primary-position pawl, and the driver imparts a driving force directly on the abutment to rotate said primary-position pawl out from its primary position, and wherein in a first position intermediate between an open position and the primary position, the first position pawl is directly engaged with the catch.

2. The lock of claim 1, wherein said abutment is a pin.

3. The lock of claim 2, wherein said pin is plastic.

4. The lock of claim 1, wherein said catch biases said primary position pawl toward the open position and presses against said primary-position pawl when said primary position pawl is in the primary position.

5. The lock of claim 2, wherein said pin is connected as a single part to a lever arm of said primary-position pawl, and said primary-position pawl is partially or fully plastic.

6. The lock of claim 5, with a limiter for engaging said lever arm of said primary-position pawl to limit the extent of movement of the primary-position pawl away from its primary position.

7. The lock of claim 6, wherein said limiter also functions as a stop for limiting the extent of movement of said first-position pawl.

8. The lock of claim 1, wherein said first-position pawl is biased toward said first position by a spring.

9. The lock of claim 8, wherein an arm of said spring pushes against an end of a lever arm of said first-position pawl, wherein said end is perpendicular to a wall, to which wall said catch is rotatably mounted.

10. The lock of claim 1, wherein in the first position, a portion of the lateral contour area of the first position pawl is directly engaged with the catch.

* * * * *